US006439796B1

(12) United States Patent
Ruvang et al.

(10) Patent No.: US 6,439,796 B1
(45) Date of Patent: Aug. 27, 2002

(54) CONNECTOR PIN APPARATUS AND ASSOCIATED METHODS

(75) Inventors: John A. Ruvang, Hickory Creek; Wesley E. Martin, Carrollton, both of TX (US)

(73) Assignee: GH Hensley Industries, Inc., Dallas, TX (US)

( * ) Notice: Subject to any disclaimer, the term of this patent is extended or adjusted under 35 U.S.C. 154(b) by 0 days.

(21) Appl. No.: 09/630,907

(22) Filed: Aug. 2, 2000

(51) Int. Cl.[7] ..... E02F 9/28
(52) U.S. Cl. ..... 403/157; 403/223; 37/455
(58) Field of Search ..... 403/157, 153, 403/154, 155, 156, 220, 223; 37/455

(56) References Cited

U.S. PATENT DOCUMENTS 2,893,722 A * 7/1959 Beck ..... 403/220
3,042,394 A * 7/1962 Bliss ..... 403/320
3,231,040 A * 1/1966 Blanchette ..... 403/220
3,831,298 A 8/1974 Helton et al.
5,077,918 A 1/1992 Garman
5,638,621 A 6/1997 Keech et al.
5,784,813 A 7/1998 Balassa et al.
5,909,962 A 6/1999 Livesay et al.
5,926,982 A 7/1999 Keech et al.

* cited by examiner

*Primary Examiner*—Lynne H. Browne
*Assistant Examiner*—John R. Cottingham
(74) *Attorney, Agent, or Firm*—Konneker & Smith, P.C.

(57) ABSTRACT

A connector pin assembly for releasably retaining a replaceable excavating tooth point on an adapter nose has opposite rigid body portions that are threadingly connected to one another in a manner permitting them to be selectively moved axially toward and away from one another, and a resilient structure captively retained between facing ends of the body portions. The connector pin assembly may be operatively inserted into the aligned point and adapter openings without the need to pound it in. Once the connector pin assembly is in place within the point and adapter openings the rigid body portions are threadingly moved toward one another to thereby compress the resilient structure in a manner forcing it against an interior surface portion of the adapter opening.

34 Claims, 2 Drawing Sheets

CONNECTOR PIN APPARATUS AND ASSOCIATED METHODS

BACKGROUND OF THE INVENTION

The present invention generally relates to material displacement apparatus and, in a preferred embodiment thereof, more particularly relates to apparatus for releasably coupling a replaceable excavating tooth point or other wear member to an associated adapter nose structure.

A variety of types of material displacement apparatus are provided with replaceable wear portions that are removably carried by larger base structures and come into abrasive, wearing contact with the material being displaced. For example, excavating tooth assemblies provided on digging equipment such as excavating buckets or the like typically comprise a relatively massive adapter portion which is suitably anchored to the forward bucket lip and has a reduced cross-section, forwardly projecting nose portion, and a replaceable tooth point having formed through a rear end thereof a pocket opening that releasably receives the adapter nose. To captively retain the point on the adapter nose, generally aligned transverse openings are formed through these interchangeable elements adjacent the rear end of the point, and a suitable connector structure is driven into and forcibly retained within the aligned openings to releasably anchor the replaceable tooth point on its associated adapter nose portion.

The connector structure typically has to be forcibly driven into the aligned tooth point and adapter nose openings using, for example, a sledge hammer. Subsequently, the inserted connector structure has to be forcibly pounded out of the point and nose openings to permit the worn point to be removed from the adapter nose and replaced. This conventional need to pound in and later pound out the connector structure can easily give rise to a safety hazard for the installing and removing personnel.

A need accordingly exists for an improved connector structure that eliminates or at least substantially reduces this problem typically associated with conventional pound-in type connectors used to releasably retain a replaceable tooth point on an adapter nose. It is to this need that the present invention is directed.

SUMMARY OF THE INVENTION

In carrying out principles of the present invention, in accordance with a preferred embodiment thereof, improved connector apparatus is provided for captively retaining an excavating wear member, such as a replaceable excavating tooth point, on an adapter nose. The adapter nose is complementarily and removably receivable in a socket portion of the wear member in a manner substantially aligning connection openings extending through the wear member and adapter nose.

The connector apparatus is representatively a connector pin assembly comprising first and second connector body members, and cooperatively engageable threaded structures operative to forcibly move the first and second connector body members toward one another in a first direction parallel to the longitudinal axis of the connector pin assembly. A resilient structure is interposable between the first and second connector body members and is operative to be resiliently compressed thereby in the first direction in response to forcible movement of the first and second connector body members toward one another in the first direction by operation of the threaded structures.

The threaded structures, although they may be separate from the connector bodies, are preferably formed integrally therewith. Representatively, the connector bodies have cylindrical shapes and the threaded structures include a reduced diameter externally threaded portion of the first connector body axially projecting from one of its ends, and an internally threaded axial end opening formed in the second connector body and into which the reduced diameter projection on the first connector may be threaded.

In a first illustrated embodiment of the connector pin assembly, the resilient structure has a tubular shape, circumscribes the reduced diameter externally threaded first connector body projection, has opposite ends that face annular inner end surfaces on the first and second connector body portions, and is of an elastomeric material. Illustratively, annular flat washers are interposed between the tubular member ends and these annular inner end surfaces. When the first and second connector bodies are threadingly advanced axially toward one another, the tubular resilient member is axially compressed and radially expanded outwardly beyond the side peripheries of the first and second connector bodies.

This first embodiment of the connector pin assembly is illustratively utilized in conjunction with an overall wear member/adapter assembly in which the adapter nose opening has an annular interior side surface recess therein. With the connector pin resilient structure in its relaxed state, the connector pin assembly is axially inserted into the substantially aligned wear member and adapter nose opening until the resilient structure is generally aligned with the annular nose opening recess. Then, using outer end drive socket openings in the connector body members, the body members are threadingly advanced toward one another to axially compress and radially expand the resilient structure, thereby causing it to radially expand into the annular nose opening recess and come into forcible contact with its side surface.

This captively retains the inserted connector pin assembly within the adapter nose and wear member openings via both a frictional engagement between a side surface portion of the adapter nose opening and a mechanical interlock between the radially expanded resilient structure and the nose opening annular recess that receives it. The interengagement of the radially expanded resilient structure and the adapter nose resiliently mounts the connector pin in the adapter nose and wear member openings and resiliently resists axial operating loads imposed on the inserted connector pin assembly. Opposite end portions of the inserted connector pin assembly are received in the wear member openings and block the wear member against removal from the adapter nose which its socket receives.

While the interior of the adapter nose opening is preferably provided with the described annular side surface recess to radially receive the radially expanded resilient structure, this recess may be eliminated, if desired, so that the radially expanded resilient structure removably holds the inserted connector pin assembly in place solely by means of the frictional interengagement between the radially expanded resilient structure and a facing interior side surface portion of the adapter nose opening.

In a second version of the overall wear member/adapter assembly, an annular projection is formed within the adapter nose opening and has oppositely facing annular ledge surfaces thereon. A second embodiment of the connector pin assembly is used in this wear member/adapter assembly and incorporates therein a resilient structure that comprises a pair of annular flat resilient washers that are preferably of an elastomeric material. This connector pin assembly is operatively inserted into the substantially aligned wear member and adapter nose openings by inserting the first and second connector body portions inwardly through opposite ends of the aligned wear member/adapter nose openings in a manner such that the reduced diameter externally threaded portion passes through the interior adapter nose opening projection, with the resilient washers being interposed between the opposite annular ledge surfaces and the facing inner ends of the first and second connector body portions.

When the first and second connector body portions are threadingly advanced axially toward one another, the body portions compress the annular resilient washers against the annular ledge surfaces to thereby resiliently mount the inserted connector pin assembly within the substantially aligned wear member and adapter nose openings. Opposite ends of the inserted connector pin assembly are received in the wear member openings to block removal of the wear member from the adapter nose.

Neither representative embodiment of the connector pin assembly needs to be forcibly driven into the substantially aligned wear member and adapter nose openings to operatively install the connector pin assembly—it is simply inserted into such openings and then threadingly tightened to operatively deform its resilient section.

DETAILED DESCRIPTION

Figure 1:
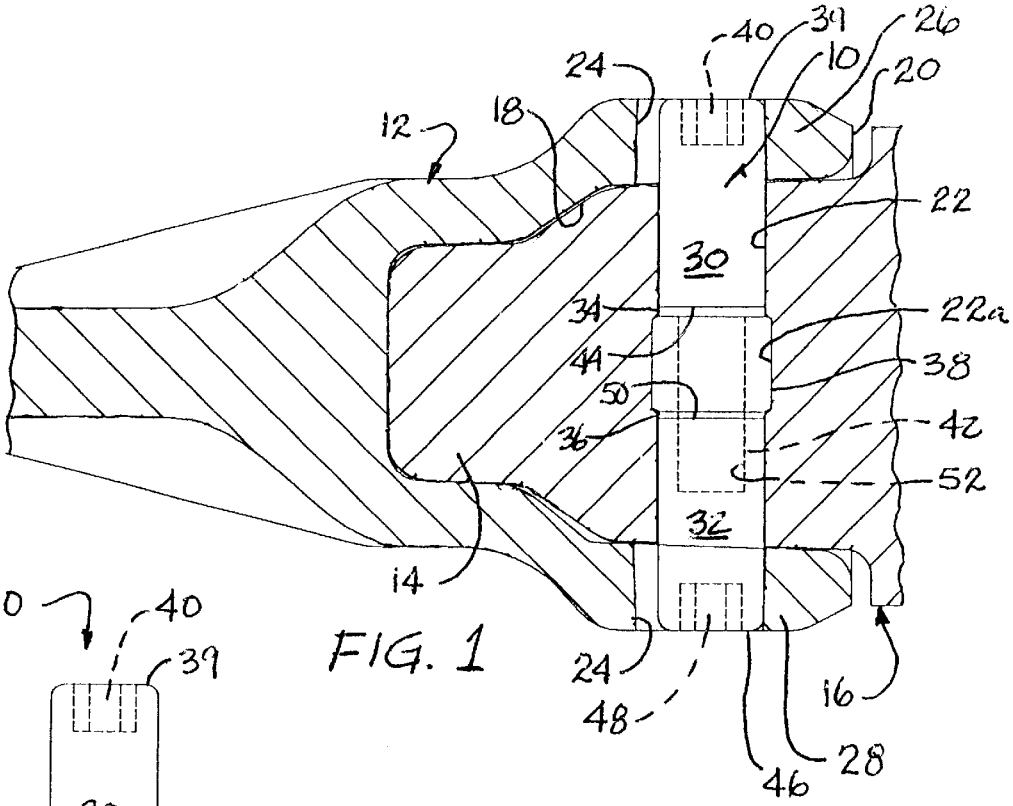
FIG. 1 is a partly elevational cross-sectional view of a nose portion of an adapter and a replaceable excavating tooth point releasably held on the adapter nose by a specially designed connector pin assembly embodying principles of the present invention.

AS illustrated in FIGS. 1–4, in a depicted preferred embodiment thereof this invention provides a specially designed cylindrical connector pin assembly 10 that is used to releasably hold a wear member, representatively an excavating tooth point 12, on the nose 14 of an associated support member, representatively an adapter structure 16. It will be appreciated by those of skill in this particular art that other types of wear members, such as for example an intermediate adapter, could also be captively and releasably retained on the adapter nose 14 by the connector pin assembly 10 if desired.

In a conventional manner, the replaceable tooth point 12 has an internal socket 18 extending inwardly from its rear end 20, with the adapter nose 14 being complementarily received in the socket 18. A transverse, circularly cross-sectioned opening 22 extends through the adapter nose 14 and is generally aligned with corresponding openings 24 formed in opposite side wall portions 26,28 of the tooth point 12. In a manner subsequently described herein, the connector pin assembly 10 is inserted into the aligned openings 22,24 and is retained therein to thereby retain the tooth point 12 in place on the adapter nose 14.

The connector pin assembly 10 provides substantial improvements with respect to cylindrical "snap-ring" connectors that have bodies which must be pounded (for example, with a sledge hammer) into the aligned adapter nose and tooth point openings 22,24 to compress a snap ring carried in an annular groove on the pin body and then permit the compressed snap ring to expand into an enlarged opening portion within the adapter nose 14 to thereby lock the inserted pin within the adapter nose and tooth openings 22,24. This previously utilized connector pin structure has several disadvantages—for example, the inherent hazards of having to pound the pin in and out of the adapter/tooth assembly, and the potential for operational impact loads imposed on the inserted pin structure to dislodge it from the tooth/adapter assembly.

Figure 2:
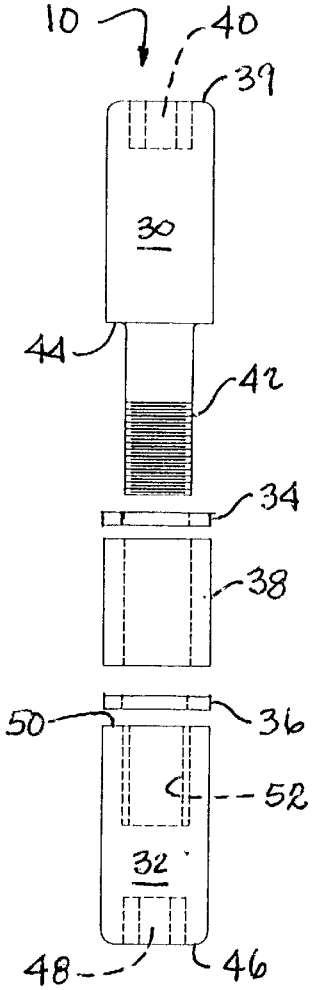
FIG. 2 is an exploded side elevational view of the connector pin assembly removed from the tooth point and adapter nose.

The specially designed connector pin assembly 10 shown in exploded form in FIG. 2, includes first and second cylindrical metal longitudinal body portions 30 and 32, upper and lower annular metal washers 34 and 36, and a tubular resilient member 38 which is representatively of an elastomeric material. The first cylindrical portion 30 has an outer end 39 with a square or hexagonal recess 40 therein, and a reduced diameter, externally threaded inner end portion 42 projecting downwardly from an annular shoulder 44 on the first cylindrical portion 30.

Figure 3:
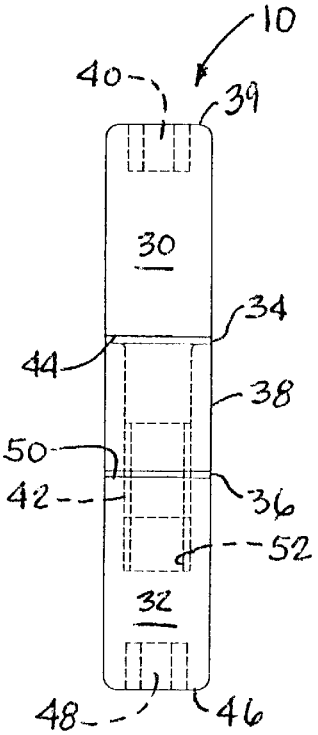
FIG. 3 is an assembled side elevational view of the connector pin assembly with a longitudinally intermediate resilient portion being in a relaxed state.

The second cylindrical portion 32 has an outer end 46 with a square or hexagonal recess 48 formed therein, and an inner end 50 with an internally threaded, circularly cross-sectioned opening 52 extending thereinto. To assemble the connector pin assembly 10, as shown in FIG. 3, the externally threaded portion 42 of the first pin structure portion 30 is sequentially passed through the upper washer 34, the tubular elastomeric member 38 and the lower washer 36 and then threaded into the second connector pin portion opening 52 as shown in FIG. 3. In this initially assembled configuration of the connector pin assembly 10, the shoulder 44 abuts the washer 34, and the inner end 50 of the lower connector pin portion 32 abuts the washer 36, but the tubular elastomeric member 38 is in a relaxed state in which it is not substantially compressed in an axial direction.

Figure 4:
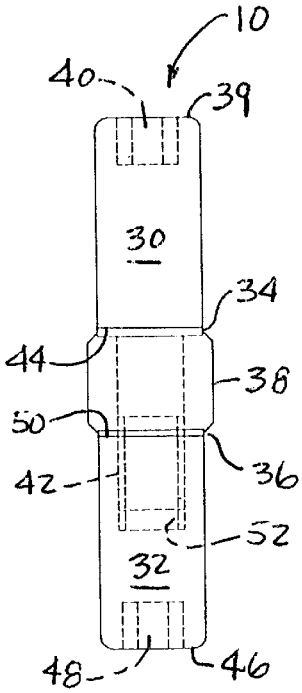
FIG. 4 is an assembled side elevational view of the connector pin assembly with the annular resilient portion being axially compressed and radially expanded.

The connector pin assembly 10 in its initially assembled, ready-to-install FIG. 3 orientation is then inserted into the aligned adapter nose and tooth point openings 22,24 until the tubular elastomeric member 38 is generally opposite a radially enlarged portion 22*a* of the adapter nose opening 22. The threaded end 42 of pin portion 30 is then screwed further into the opening 52 of the other pin portion 32 to thereby force the shoulder 44 closer to the inner end 50 of the pin portion 32. This, in turn, forces the washers 34,36 closer together to thereby axially compress and radially expand the tubular elastomeric member 38 as shown in FIG. 4. With the connector pin assembly 10 inserted into the aligned adapter nose and tooth point openings 22,24 as shown in FIG. 1, this causes the radially expanded tubular elastomeric member 38 to enter the radially enlarged adapter nose opening portion 22*a* and lock the inserted connector pin assembly 10 in place against axial removal from the openings 22,24. This, in turn, locks the tooth point 12 on the adapter nose 14.

AS can be seen in FIG. 1, the locking of the inserted connector pin assembly 10 within the generally aligned tooth point and adapter nose openings is achieved by a combination of (1) a frictional engagement between the radially expanded elastomeric member 38 and a side surface portion of the adapter nose opening 22, and (2) a mechanical interlock between the radially expanded elastomeric member 38 and the enlarged adapter nose opening portion 22*a* that receives it. It will be readily appreciated by those of skill in this particular art, however, that the enlarged adapter nose opening portion 22 could be eliminated, if desired, so that the radially enlarged elastomeric member could frictionally engage a side portion of the opening 22 without being mechanically interlocked with the adapter nose. Alternatively, the enlarged opening portion 22*a* could be sized in a manner such that the frictional engagement of the radially enlarged elastomeric member 38 with the side of the opening portion was eliminated, and only a mechanical interlock between the elastomeric member 38 and the adapter nose was utilized.

To remove the inserted connector pin assembly 10 from the adapter nose and tooth point openings 22,24 the upper pin portion 30 is rotationally backed out of the pin portion 32 to cause the tubular elastomeric member 38 to return to its FIG. 3 relaxed configuration and permit the connector pin assembly 10 to be simply pushed out of the aligned adapter nose and tooth point openings 22,24.

The unique construction of the connector pin assembly 10 permits it to be installed within the aligned adapter nose and tooth point openings without having to pound the connector pin assembly into such holes. Further, the expanded elastomeric member 38 within the radially enlarged adapter nose hole portion 22*a* acts as a "shock absorber" which desirably tends to hinder dislodgement of the inserted connector pin assembly 10 when axially directed operational loads are imposed thereon.

Figure 5:
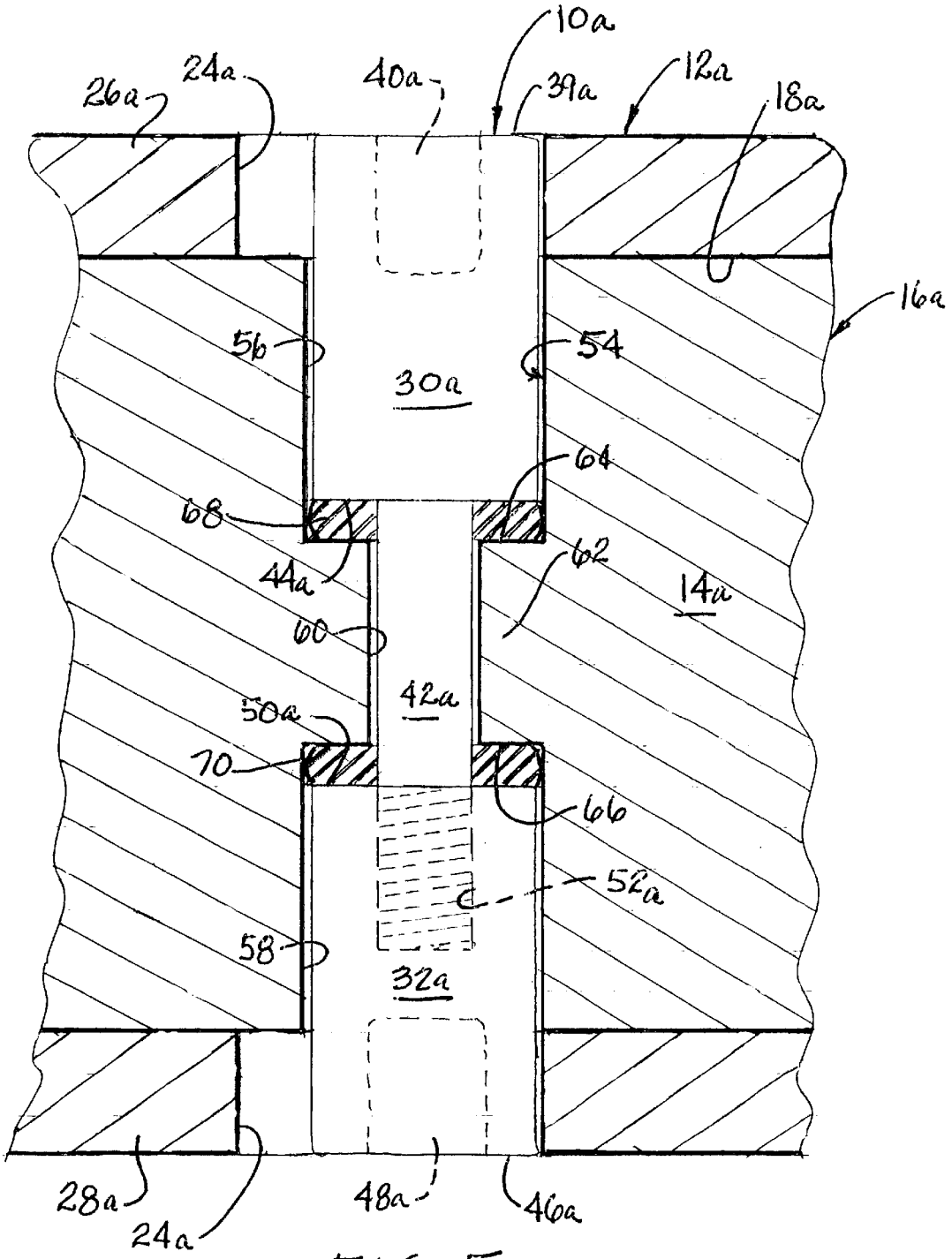
FIG. 5 is a partly elevational cross-sectional view of the replaceable excavating tooth point releasably held on a differently configured adapter nose by an alternate embodiment of the connector assembly.

An alternate embodiment 10*a* of the previously described connector pin assembly 10 is shown in FIG. 5 being used to captively retain an excavating tooth point 12*a* on an adapter nose 14*a*. For the purpose of facilitating a comparison of the FIG. 5 overall point/adapter/connector pin assembly with its previously described FIG. 1 counterpart, components similar or identical to those in FIG. 1 have been given identical reference numerals with the subscripts "a".

The tooth point 12*a* shown in FIG. 5 is identical to the previously described tooth point 12 and has a pocket area 18*a* and opposite sidewalls 26*a*, 28*a* with openings 24*a* formed therein. Adapter nose 14*a* which is complementarily received in the tooth point pocket 18*a* has a circularly cross-sectioned opening 54 extending therethrough and generally aligned with the tooth point openings 24*a*. The adapter nose opening 54 is configured differently than the previously described adapter nose opening 22 (see FIG. 1), having upper and lower end segments 56 and 58 separated by a smaller diameter longitudinally intermediate segment 60. Reduced diameter opening segment 60 is defined by an annular section 62 of the adapter nose 14*a* that radially projects into the nose opening 54 and has upper and lower axially facing annular ledges 64,66.

The resilient intermediate portion of the connector pin assembly 10*a* is defined by upper and lower annular resilient members 68,70 which are representatively of an elastomeric material. Upper resilient member 68 circumscribes the reduced diameter threaded end portion 42*a* of the upper rigid body portion 30*a* received in the upper nose opening segment 56, and is interposed between the annular shoulder 44*a* of the rigid body portion 30*a* and the upper annular nose opening ledge 64. Lower resilient member 70 circumscribes the reduced diameter threaded end portion 42*a* of the upper rigid body portion 30*a*, and is interposed between the annular shoulder 50*a* of the rigid body portion 32*a* and the lower annular nose opening ledge 66.

With the adapter nose 14*a* received in the tooth point socket 18*a*, the connector pin assembly 10*a* may be easily installed, without having to pound its components into the point and adapter openings, by placing the annular resilient member 68 on the reduced diameter body portion 42*a*, inserting the upper rigid body portion 30*a* into the upper adapter nose opening segment 56 so that the reduced diameter body portion 42*a* extends downwardly through the middle nose opening segment 60 and into the lower nose opening segment 58, placing the lower annular elastomeric member 70 on the lower end of the body portion 42*a*, and threading the lower rigid body portion 32*a* onto the threaded body portion 42*a*.

Finally, using the square or hexagonal recesses 40*a*, 48*a* and suitable upper and lower wrench members, the rigid body portions 30*a*, 32*a* are threadingly advanced toward one another in a manner axially compressing and radially expanding the annular resilient members 68,70 respectively between facing annular surface pairs 44*a*, 64 and 50*a*, 66. In this manner, the resilient members 68,70 are compressed against interior surface portions of the adapter nose opening 54, thereby facilitating the retention of the connector pin assembly 10*a* within the generally aligned point and adapter openings 24*a*,54 and providing the installed connector pin assembly 10*a* with axial resiliency against axial operational loads imposed thereon. AS in the case of the previously described connector pin assembly 10, opposite outer end portions of the installed connector pin assembly 10*a* serve to block the removal of the tooth point 12*a* from the adapter nose 14*a* onto which it is telescoped.

A variety of modifications could be made to the connector pin assemblies 10 and 10*a* without departing from principles of the present invention. For example, while the resilient members 38 (FIG. 1) and 68,70 (FIG. 5) are preferably formed from an elastomeric material, they could be of alternate resilient constructions such as, for example, metal compression springs or bellows. Additionally, while the upper and lower rigid body portion pairs 30,32 and 30*a*,32*a* are threadingly movable axially toward and away from another by virtue of one body portion being directly screwed into the other one, such body portion pairs could alternatively be made to be threadingly movable axially toward and away from one another using a third threaded element, such as a bolt extending axially through one of the rigid body portions and being threaded into the other one. Moreover, while the resilient members 38,68,70 are radially deflectable through a 360 degree arc, such radial deflection could extend through a lesser arc if desired.

The foregoing detailed description is to be clearly understood as being given by way of illustration and example, the spirit and scope of the present invention being limited solely by the appended claims.

What is claimed is:

1. Connector apparatus insertable into substantially aligned holes in an excavating wear member and an adapter member onto which the wear member is telescoped, said connector apparatus being operative to captively retain the wear member on the adapter member and comprising:

first and second elongated cylindrical connector body members having substantially identical diameters along their lengths;

cooperatively engageable threaded structures carried by said first and second connector body members and operative to coaxially interconnect said first and second connector body members with a longitudinally central annular space formed between facing end portions of said first and second connector body members, and to permit said first and second connector body members to be threadingly moved axially toward and away from one another; and a resilient structure having an annular configuration and being coaxially positionable in said longitudinally central annular space to be axially compressed when said first and second cylindrical body members are moved axially toward one another, and be axially uncompressed when said first and second connector body members are moved axially away from one another, said resilient structure projecting laterally outwardly beyond said facing end portions of said first and second connector body members only when said resilient structure is axially compressed.

2. The connector apparatus of claim 1 wherein said cooperatively engageable threaded structures are integral portions of said first and second connector body members.

3. The connector apparatus of claim 2 wherein:

said cooperatively engageable threaded structures include an externally threaded, reduced diameter end portion of said first connector body member, and an internally threaded hole extending axially into an end of said second connector body member and configured to threadingly receive said externally threaded, reduced diameter end portion of said first connector body member.

4. The connector apparatus of claim 3 wherein:

said resilient structure is a resilient tubular member configured to coaxially receive said reduced diameter end portion of said first connector body member with opposite ends of said resilient tubular member facing annular surface portions of said first and second connector body members.

5. The connector apparatus of claim 4 wherein said resilient tubular member is of an elastomeric material.

6. The connector apparatus of claim 4 further comprising a pair of annular washer members configured to coaxially circumscribe said reduced diameter end portion of said first connector body member with each washer member being interposed between an end of said resilient tubular member and said annular surface portions of said first and second connector body members.

7. The connector apparatus of claim 3 wherein:

said resilient structure includes first and second resilient annular members configured to coaxially receive said reduced diameter end portion of said first connector body member with side surfaces of said annular members facing annular surface portions of said first and second connector body members.

8. The connector apparatus of claim 7 wherein said first and second resilient annular members are of an elastomeric material.

9. Connector apparatus insertable into substantially aligned holes in an excavating wear member and an adapter member onto which the wear member is telescoped, said connector apparatus being operative to captively retain the wear member on the adapter member and comprising:

first and second connector body members;

cooperatively engageable threaded structures operative to forcibly move said first and second connector body members toward one another in a first direction; and a resilient structure interposable between said first and second connector body members and operative to be resiliently compressed thereby in said first direction in response to forcible movement of said first and second connector body members toward one another in said first direction by operation of said threaded structures, said first and second connector body members having generally cylindrical configurations, said cooperatively engageable threaded structures including an externally threaded, reduced diameter end portion of said first connector body member, and an internally threaded hole extending axially into an end of said second connector body member and configured to threadingly receive said externally threaded, reduced diameter end portion of said first connector body member, and said first and second connector body members having outer end surfaces with sockets extending inwardly therethrough and having noncircular cross-sections.

10. The connector apparatus of claim 1 wherein:

said resilient structure is a resilient tubular member having a longitudinal axis and being interposable between said first and second connector body members to be axially compressed and radially expanded in response to forcible movement of said first and second connector body members toward one another by operation of said threaded structures.

11. The connector apparatus of claim 10 wherein said resilient tubular member is of an elastomeric material.

12. The connector apparatus of claim 1 wherein:

said resilient structure includes first and second annular resilient members coaxially interposable between said first and second connector body members to be axially compressed in response to forcible movement of said first and second connector body members toward one another by said threaded structures.

13. The connector apparatus of claim 12 wherein said first and second annular resilient members are of an elastomeric material.

14. A method of captively retaining an excavating wear member on an adapter nose, the wear member having a socket for complementarily receiving the adapter nose, the adapter nose and the wear member having wall openings therein, said method comprising the steps of:

placing the adapter nose into the wear member socket in a manner generally aligning the wear member and adapter nose openings;

providing a connector pin assembly extending along an axis and having first and second opposite end portions, a resilient structure interposed between said first and second opposite end portions, and cooperating threaded structures operative to forcibly move said first and second opposite end portions axially toward one another to axially compress said resilient structure;

axially inserting said connector pin assembly into the generally aligned wear member and adapter nose openings; and captively retaining the inserted connector pin assembly in the generally aligned wear member and adapter nose openings by using said cooperating threaded structures to forcibly move said first and second opposite end portions axially toward one another in a manner axially compressing said resilient structure.

15. The method of claim 14 wherein said captively retaining step is performed in a manner laterally expanding said resilient structure into forcible engagement with an interior side surface portion of the adapter nose opening.

16. The method of claim 14 wherein:

the adapter nose opening has, along an interior side surface portion thereof, an annular recess, and said captives retaining step is performed in a manner laterally expanding said resilient structure into said annular recess.

17. The method of claim 14 wherein:

the adapter nose opening has an annular internal projection having a pair of oppositely facing annular ledge portions, and said captively retaining step is performed in a manner compressing said resilient structure against said pair of oppositely facing annular ledge portions.

18. The method of claim 14 wherein:

said cooperating threaded structures are first and second threaded structures formed on said first and second opposite end portions of said connector pin assembly, and said captively retaining step is performed by threadingly interconnecting said first and second threaded structures.

19. Excavating apparatus comprising:

an adapter having a nose portion;

a wear member having a socket complementarily and removably receiving said nose portion;

generally aligned openings formed in said nose portion and said wear member; and a connector pin assembly removably received and captively retained in said generally aligned openings, said connector pin assembly captively retaining said wear member on said nose portion and including:

first and second rigid body portions spaced apart along an axis of said connector pin assembly, a resilient structure interposed between said body portions, and cooperating threaded structures associated with said body portions and forcing them axially toward one another in a manner axially compressing said resilient structure and forcing said resilient structure against a surface portion of said generally aligned openings.

20. The excavating apparatus of claim 19 wherein said resilient structure circumscribes said axis.

21. The excavating apparatus of claim 20 wherein said resilient structure has a tubular configuration.

22. The excavating apparatus of claim 21 wherein said resilient structure is of an elastomeric material.

23. The excavating apparatus of claim 20 wherein said resilient structure includes two spaced apart annular members.

24. The excavating apparatus of claim 23 wherein said annular members are of an elastomeric material.

25. The excavating apparatus of claim 19 wherein the resilient structure is resiliently deformed in a direction transverse to said axis and forcibly bears against a side surface portion of the nose portion opening.

26. The excavating apparatus of claim 25 wherein the resilient structure forcibly bears against an annular side surface portion of the nose portion opening.

27. The excavating apparatus of claim 26 wherein:

the nose portion opening has an annular side surface recess therein, and the resilient structure extends into said annular side surface recess.

28. The excavating apparatus of claim 19 wherein:

the adapter nose opening has an annular projection therein which has oppositely facing annular ledge surfaces, and said resilient structure forcibly bears against said annular ledge surfaces.

29. The excavating apparatus of claim 19 wherein said cooperating threaded structures are formed on said first and second rigid body portions.

30. The excavating apparatus of claim 29 wherein:

said first and second rigid body portions have cylindrical configurations and facing inner end surfaces, and said cooperating threaded structures include a reduced diameter, externally threaded axial projection disposed on said first rigid body portion and extending axially outwardly from its inner end surface, and an internally threaded opening extending axially inwardly through the inner end surface of said second rigid body portion and threadingly receiving said reduced diameter, externally threaded axial projection on said first rigid body portion.

31. The excavating apparatus of claim 30 wherein said resilient structure has a tubular configuration and circumscribes said reduced diameter, externally threaded axial projection on said first rigid body portion, said resilient structure being axially compressed, radially expanded, and preventing removal of said connector pin assembly from said generally aligned openings.

32. The excavating apparatus of claim 31 further comprising a pair of annular washers interposed between the opposite ends of said tubular resilient structure and said facing inner end surfaces of said first and second rigid body portions.

33. The excavating apparatus of claim 30 wherein:

the adapter nose opening has an annular internal projection therein which has oppositely facing annular ledge surfaces, and said resilient structure includes an axially spaced pair of annular resilient members circumscribing said reduced diameter projection and being axially compressed against said annular ledge surfaces.

34. The excavating apparatus of claim 19 wherein said first and second rigid body portions have oppositely facing outer end surfaces with noncircularly cross-sectioned driving sockets extending axially thereinto.

* * * * *